US010494785B2

(12) United States Patent
Huang et al.

(10) Patent No.: US 10,494,785 B2
(45) **Date of Patent: *Dec. 3, 2019**

(54) PILE GUIDE FRAME COUPLED WITH ROTATABLE ARM

(71) Applicant: Ship and Ocean Industries R&D Center, New Taipei (TW)

(72) Inventors: Chun-Chia Huang, New Taipei (TW); Feng-Yeang Chung, New Taipei (TW); Chia-Chuan Ou, New Taipei (TW); Ying-Chao Liao, New Taipei (TW)

(73) Assignee: SHIP AND OCEAN INDUSTRIES R&D CENTER, New Taipei (TW)

( * ) Notice: Subject to any disclaimer, the term of this patent is extended or adjusted under 35 U.S.C. 154(b) by 0 days.

This patent is subject to a terminal disclaimer.

(21) Appl. No.: 16/004,457

(22) Filed: Jun. 11, 2018

(65) Prior Publication Data

US 2018/0355574 A1 Dec. 13, 2018

(30) Foreign Application Priority Data

Jun. 12, 2017 (TW) ..... 106119521 A

(51) Int. Cl.

| | |
|---|---|
| ***E02D 13/04*** | (2006.01) |
| ***E21B 41/08*** | (2006.01) |
| *E02D 7/14* | (2006.01) |

(52) U.S. Cl.
CPC ..... *E02D 13/04* (2013.01); *E21B 41/08* (2013.01); *E02D 7/14* (2013.01)

(58) Field of Classification Search
CPC ..... E02D 13/04; E02D 7/14; E02D 27/525; E21B 41/08
See application file for complete search history.

(56) References Cited

U.S. PATENT DOCUMENTS

| | | | | |
|---|---|---|---|---|
| 2,927,435 | A * | 3/1960 | Upson | E02B 17/00 405/227 |
| 3,751,930 | A * | 8/1973 | Mott | B63B 35/4413 173/195 |
| 3,754,403 | A * | 8/1973 | Mott | E02B 17/0004 173/195 |
| 4,618,286 | A * | 10/1986 | Michel | E02B 17/0021 405/208 |
| 2011/0129301 | A1* | 6/2011 | Wang | B63B 21/27 405/205 |
| 2011/0318113 | A1* | 12/2011 | Fraenkel | E02B 17/02 405/224 |
| 2013/0183101 | A1* | 7/2013 | Vandenbulcke | E02D 13/04 405/204 |

* cited by examiner

*Primary Examiner* — Carib A Oquendo
(74) *Attorney, Agent, or Firm* — Cheng-Ju Chiang

(57) ABSTRACT

A pile guide frame is coupled with at least one rotatable arm and includes a plurality of leveling modules for compensating for differences in height of the seabed. The rotatable arm can be rotated along a supporting frame and thereby move a pile guide module to facilitate pile-driving operations.

11 Claims, 7 Drawing Sheets

PILE GUIDE FRAME COUPLED WITH ROTATABLE ARM

CROSS-REFERENCE TO RELATED APPLICATION AND CLAIM OF PRIORITY

This application claims the benefit of Taiwanese Patent Application No. 106119521, filed on Jun. 12, 2017, in the Taiwan Intellectual Property Office, the disclosure of which is incorporated herein its entirety by reference.

TECHNICAL FIELD

This invention relates to a guide frame coupled with a rotatable arm. More particularly, the invention relates to a guide frame for underwater pile-driving operations, the guide frame includes at least one rotatable arm rotatable on a supporting frame to facilitate determination of pile positions.

DESCRIPTION OF THE RELATED ART

For many major constructions above or under water, a secure seabed foundation is required, and only when the foundation is completed can subsequent construction work begin. Recently, the increase of marine construction projects such as those of offshore wind turbines has brought more and more attention to the importance of underwater pile-driving operations, which are typically used to secure the foundations of offshore platforms and practically all structures to be erected on the ocean floor.

Before a pile is driven, a pile guide frame adaptable to different seabed topologies is generally called for to determine the position of the pile and adjust the angle at which the pile is to be driven into the seabed. When laying a multi-pile foundation, it is common practice to use a conventional pile-driving method and pile guide frame in conjunction with a jack-up barge, whose levelness is directly taken as that of the pile guide frame, and whose legs serve to guide the pile guide frame while the pile guide frame is being lowered by a winch. During the process, the levelness of the pile guide frame is detected on the principle of communicating vessels.

The foregoing technique depends on the use of specific types of carriers, and yet the procurement or adaptation of such carriers is both time-consuming and costly.

Another type of pile guide frames allows underwater adjustment. More specifically, a mechanical structure is provided between the pile guide sleeves of such a frame to change the distance between each two adjacent sleeves. In addition, a leveling mechanism is provided to compensate for height variations of the ocean floor, thereby maintaining the levelness and height of the pile guide frame. The leveling mechanism is generally configured for adjustment through horizontal and/or vertical displacement. In some cases, the pile guide sleeves are manufactured as openable structures or provided with an internal openable structure to meet pile-driving needs.

Moreover, a conventional pile guide frame must have as many pile guide sleeves as the piles to be driven through the pile guide frame. The multiple sleeves, however, incur a significant increase in cost and weight of the pile guide frame, which can be an issue to pile guide frame users.

SUMMARY

To solve the aforesaid problems of the prior art, the present invention provides a pile guide frame coupled with at least one rotatable arm and a method for operating the same. The pile guide frame includes a supporting frame, a rotation module, at least one leveling module, at least one rotatable arm, and a pile guide module.

The supporting frame is provided with at least one rail surface. The rotation module is provided at the center of the supporting frame. The at least one leveling module is connected to the supporting frame. The at least one rotatable arm is connected to the rotation module and is movably in contact with the at least one rail surface. The pile guide module is connected to the least one rotatable arm.

DESCRIPTION OF THE PREFERRED EMBODIMENTS

It is worth mentioning in advance that the first to fourth actuators in the embodiment described below are implemented as hydraulic cylinders but are not necessarily so. Those actuators may vary as needed, provided that each of them can push and thereby move the weight it is intended for.

Figure 1:
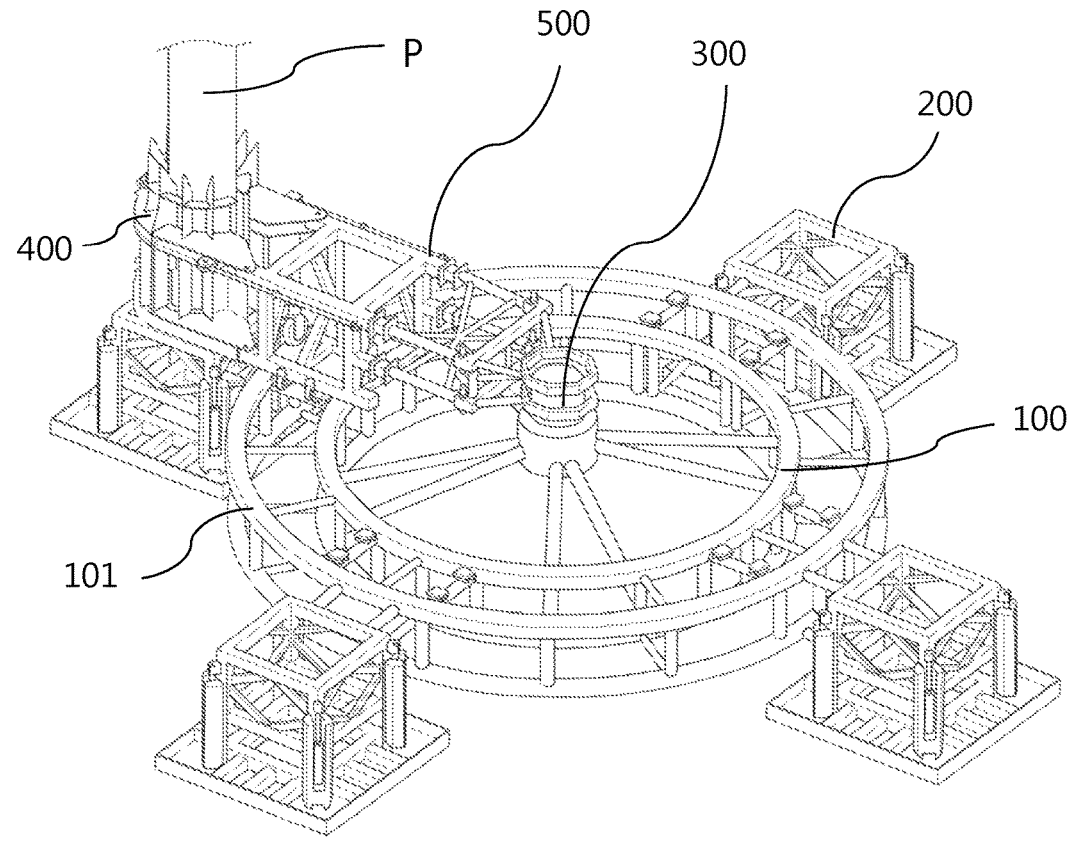
FIG. 1 is a perspective view showing the structure of an embodiment of the invention.

Referring to FIG. 1, which shows the structure of an embodiment of the present invention, a pile guide frame 10 coupled with at least one rotatable arm 500 includes a supporting frame 100, a rotation module 300, at least one leveling module 200, and a pile guide module 400, in addition to the rotatable arm 500. The rotation module 300 in this embodiment may be a hydraulic motor.

The supporting frame 100 is ring-shaped and is provided with at least one rail surface 101. The rotation module 300 is provided at the center of the supporting frame 100. The at least one leveling module 200 is connected to the supporting frame 100. The rotatable arm 500 is connected to the rotation module 300 and is movably in contact with the at least one rail surface 101. The pile guide module 400 is connected to the rotatable arm 500.

In this embodiment, the supporting frame 100 is composed of two ring-shaped frames, one larger than the other. The two ring-shaped frames provide rail surfaces 101 with which the wheels 5022 (see FIG. 7) in the slide module 502 of the rotatable arm 500 are in contact respectively. As the embodiment is intended to work under water, it is important that the rail surfaces 101 allow the wheels 5022 to roll thereon smoothly. In other possible embodiments, the supporting frame 100 may be closed rings of other geometric shapes such as quadrilaterals, triangles, and so on. That is to say, the supporting frame 100 may vary in shape, provided that the wheels 5022 can turn and roll along the closed ring-shaped supporting frame 100.

Figure 7:
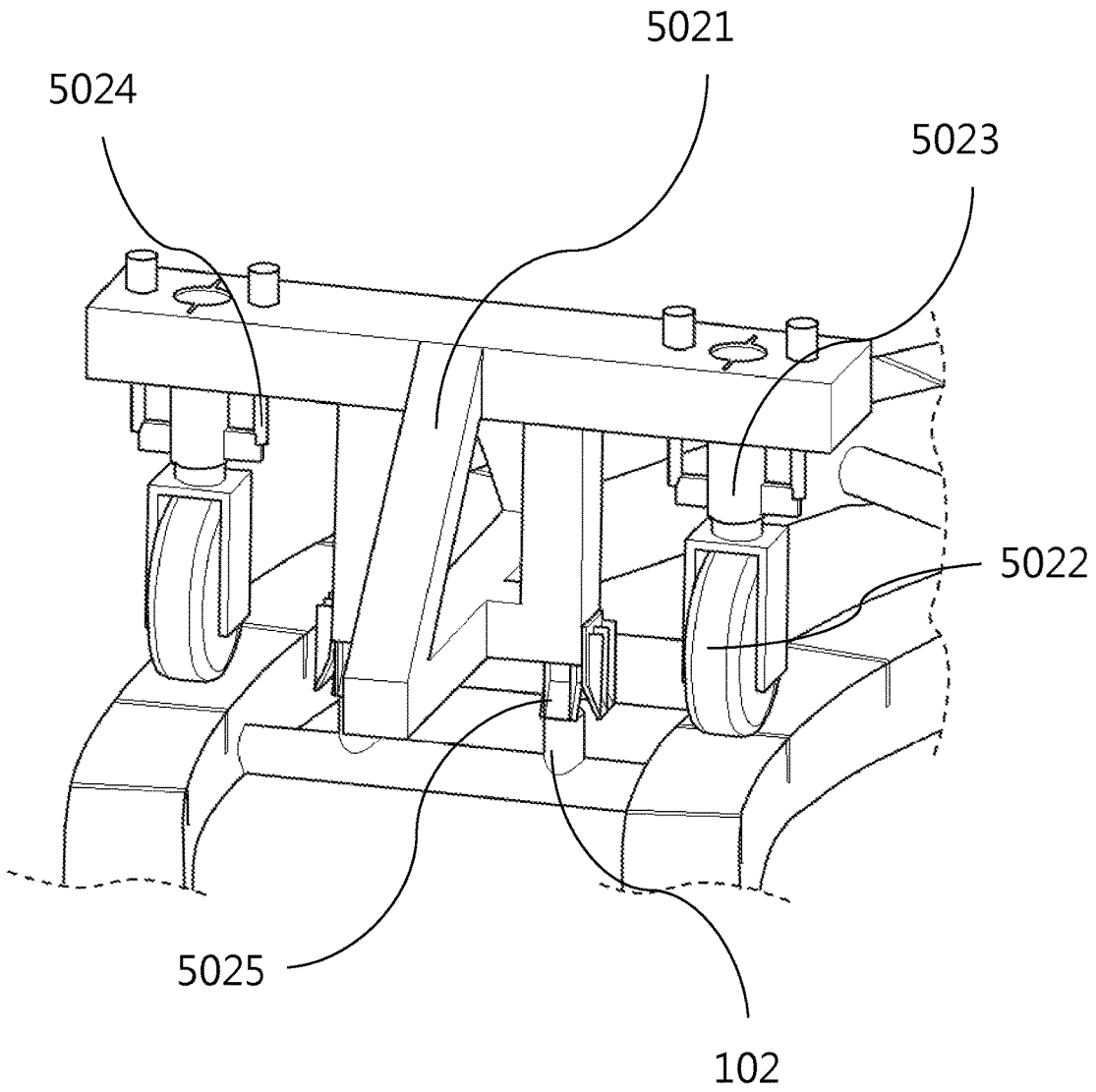
FIG. 7 is a perspective view showing the structure of the slide module of the embodiment in FIG. 1.

In this embodiment, the rail surfaces 101 are provided with a plurality of slits (see FIG. 7). The slits not only allow passage of water current but also increase friction so that the wheels 5022 are less likely to deviate from the rail formed by the rail surfaces 101. Moreover, as the rotatable arm 500 moves in a rotary manner, the actual movement of the wheels 5022 is turning continuously. To reduce the centrifugal load on the wheels 5022 and the risk associated with the load, and to facilitate movement of the wheels 5022, the rail surfaces 101 in this embodiment are tilted slightly toward the center of the supporting frame 100 (i.e., the gravity center of the closed ring shape of the entire supporting frame 100).

Figure 2:
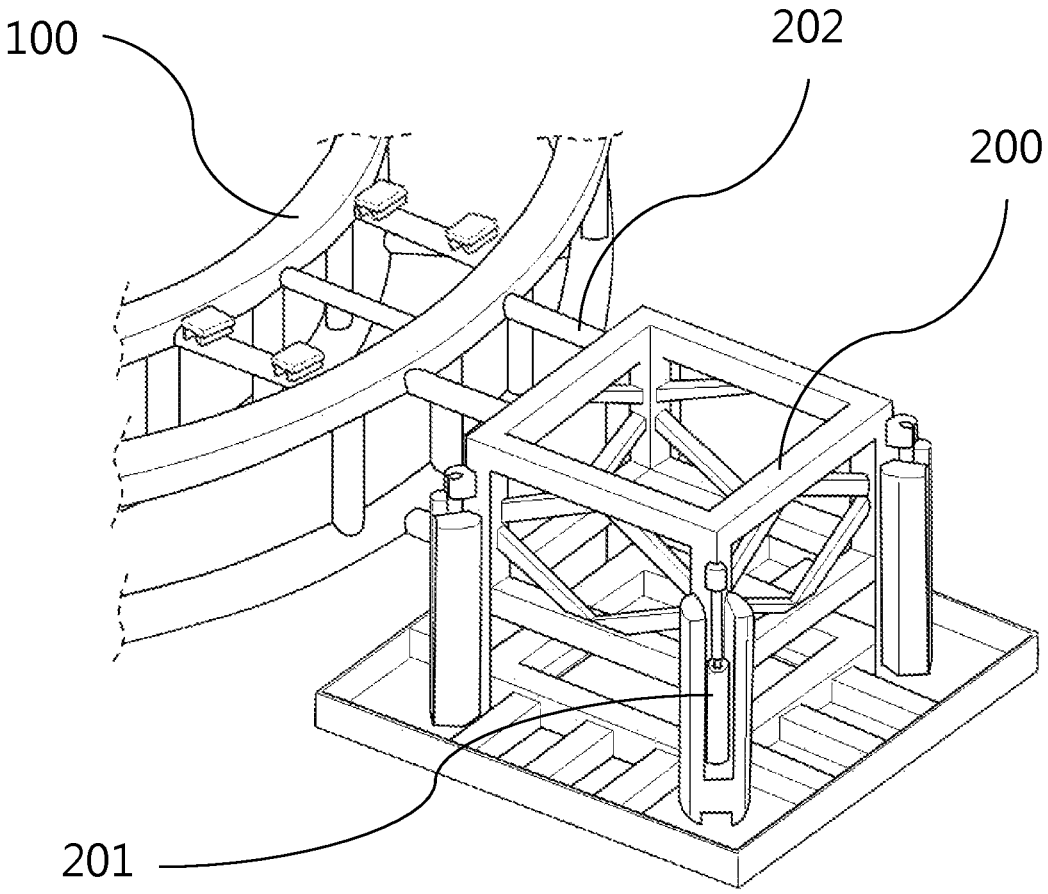
FIG. 2 is a perspective view showing the structure of a leveling module of the embodiment in FIG. 1.

Referring to FIG. 2 in conjunction with FIG. 1, FIG. 2 shows the structure of a leveling module 200 in this embodiment, at least one first adjusting member 202 is provided between each leveling module 200 and the supporting frame 100. Also, each leveling module 200 is provided with at least one fourth actuator 201. More specifically, the supporting frame 100 in this embodiment is provided with four leveling modules 200, each two adjacent ones of which are 90° apart. Each leveling module 200 has a rectangular structure including a base and a cradle, the cradle has four corners each provided with one fourth actuator 201.

Each leveling module 200 in this embodiment can be adjusted in height or inclination angle by movements of the corresponding four fourth actuators 201. The first adjusting members 202, on the other hand, can be used to adjust the distance between the supporting frame 100 and each leveling module 200. In this embodiment, therefore, the four leveling modules 200 can work in concert with one another to adjust the overall height or tilt of the supporting frame 100, thereby adapting the pile guide frame 10 to different seabed topologies, and the first adjusting members 202 can adjust the distance from each leveling module 200 to the center of the supporting frame 100 to satisfy the needs of more underwater operations than can the conventional pile guide frames.

In order for the rotatable arm 500 to move the pile guide module 400 precisely to each leveling module 200, the supporting frame 100 in this embodiment is provided with at least one set of at least one positioning block 102 and at least one set of at least one locking support 103. The at least one set of at least one positioning block 102 corresponds in position and number (four as in this embodiment) to the at least one leveling module 200, and so does the at least one set of at least one locking support 103. The positioning blocks 102 and the locking supports 103 in this embodiment can be seen in FIG. 7 and FIG. 6 respectively.

In this embodiment, only one rotatable arm 500 and only one pile guide module 400 are provided. Therefore, in cases where a pile P is not sunken entirely into the seabed or the leveling module 200 when the pile-driving operation is completed, there must be a mechanism for removing the pile guide module 400 from the pile P. In other possible embodiments, there may be more than one rotatable arm 500. For example, there may be two rotatable arms 500, which are connected to the rotation module 300 and form an included angle of 180°, or there may be three rotatable arms 500, which are connected to the rotation module 300 and each two adjacent ones of which form an included angle of 120°. In other words, the number of the at least one rotatable arm 500 in the present invention may be increased as needed without limitation, provided that a balance between rotation and speed can be achieved by the at least one rotatable arm 500.

Figure 3:
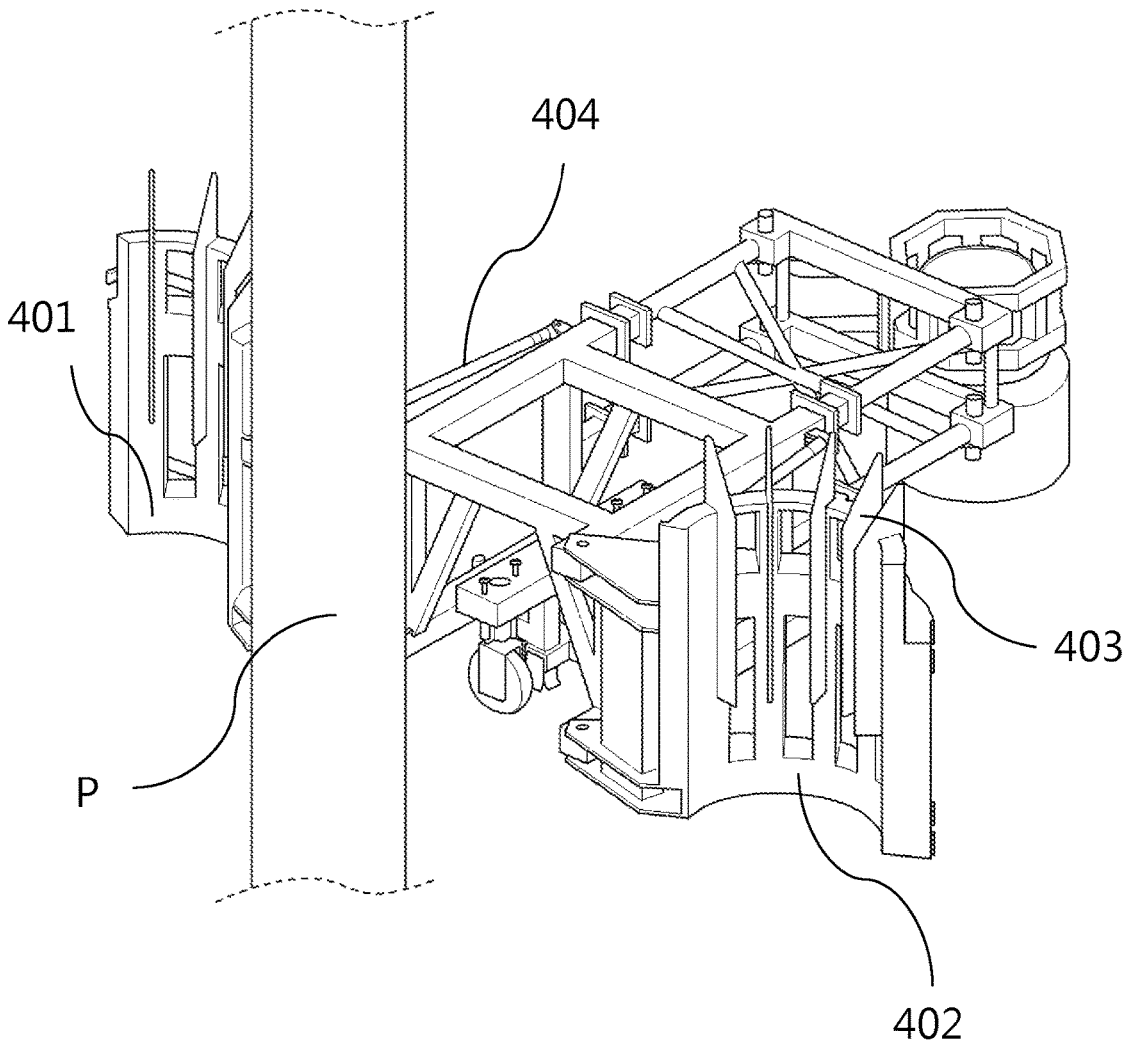
FIG. 3 is a perspective view showing the structure of the pile guide module of the embodiment in FIG. 1.
Figure 4:
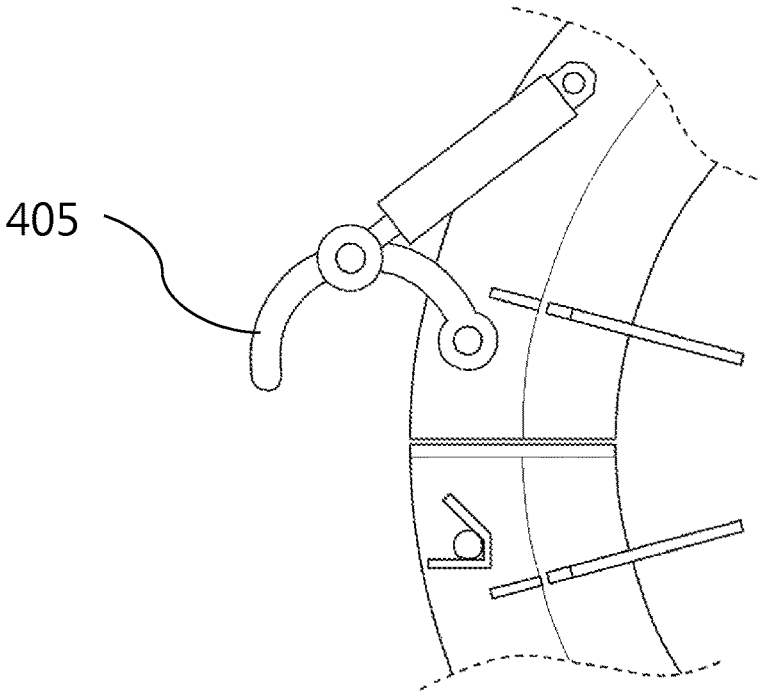
FIG. 4 is a drawing showing how the pile securing lock of the embodiment in FIG. 1 works.
Figure 5:
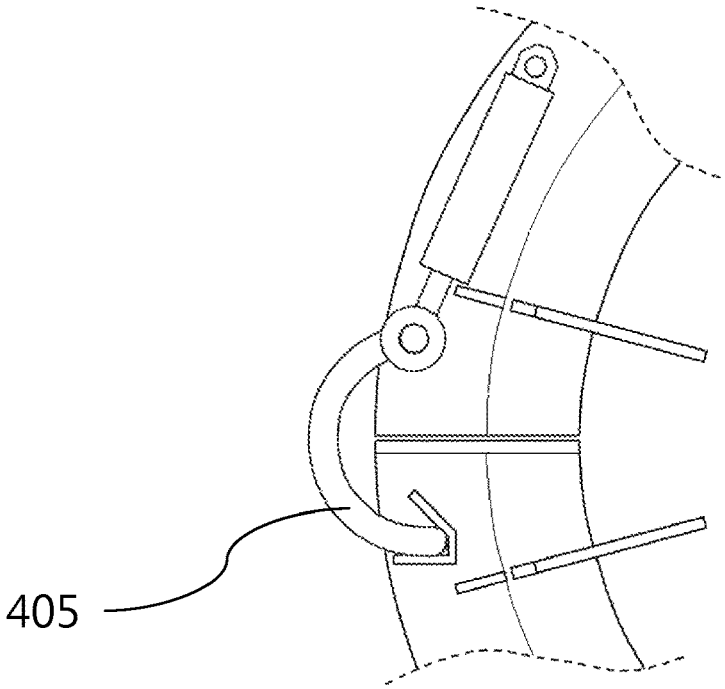
FIG. 5 is another drawing showing how the pile securing lock of the embodiment in FIG. 1 works.

Reference is now made to FIG. 3 and FIG. 4, which respectively show the structure of the pile guide module 400 in this embodiment and how the pile securing lock 405 in this embodiment is operated. As shown in FIG. 3 and FIG. 4, the pile guide module 400 in this embodiment is constructed substantially as a sleeve for guiding a pile P thereinto and then through the corresponding leveling module 200, in order for the pile P to be driven into the ocean floor.

The pile guide module 400 includes a first pile securing member 401 and a second pile securing member 402. The second pile securing member 402 can be fastened to the first pile securing member 401 using the pile securing lock 405. In addition, each of the first pile securing member 401 and the second pile securing member 402 is connected to the rotatable arm 500 via a second actuator 404.

The pile guide module 400 in FIG. 1 and FIG. 3 are shown in different states. As shown in FIG. 3, the first pile securing member 401 and the second pile securing member 402 in this embodiment are configured to be opened with respect to each other to form a predetermined included angle therebetween, the predetermined included angle ranges from 0° to 120° and is controlled by the pulling/releasing actions of the second actuators 404. Once opened, the pile guide module 400 can be rotated along with the rotatable arm 500 without contact with the pile P. Besides, each of the first pile securing member 401 and the second pile securing member 402 of the substantially sleeve-shaped pile guide module 400 is provided with at least two supporting structures 403.

The supporting structures 403 in this embodiment may be ribs, fins, or other mechanisms with a guiding function. The supporting structures 403 are provided along the circumference of the pile guide module 400 and jointly form a sleeve with a chamfered opening so as to better position and secure the pile P being placed into the pile guide module 400. The supporting structures 403 also help accelerate pile-driving operations and increase pile-driving precision. As the first pile securing member 401 and the second pile securing member 402 in this embodiment are configured as an openable mechanism, pile-driving operations will inevitably subject the two pile securing members 401 and 402 to stress.

To protect the first pile securing member 401 and the second pile securing member 402 from damage by the pile-driving stress, referring to FIG. 4, the second pile securing member 402 in this embodiment can be tightly fastened to the first pile securing member 401 by the pile securing lock 405. As shown in FIG. 4, the pile securing lock 405 is a U-shaped or horseshoe-shaped mechanism, is centrally provided with a force application point, and is rotatably connected to a hydraulic cylinder provided on the first pile securing member 401 or the second pile securing member 402 so that, by means of the hydraulic cylinder, the pile securing lock 405 can be locked and unlocked. During a pile-driving operation, the hydraulic cylinder pushes the force application point to keep the pile securing lock 405 in the locked state, thereby allowing the pile securing lock 405 to share the pile-driving stress on the first pile securing member 401 and the second pile securing member 402.

Figure 6:
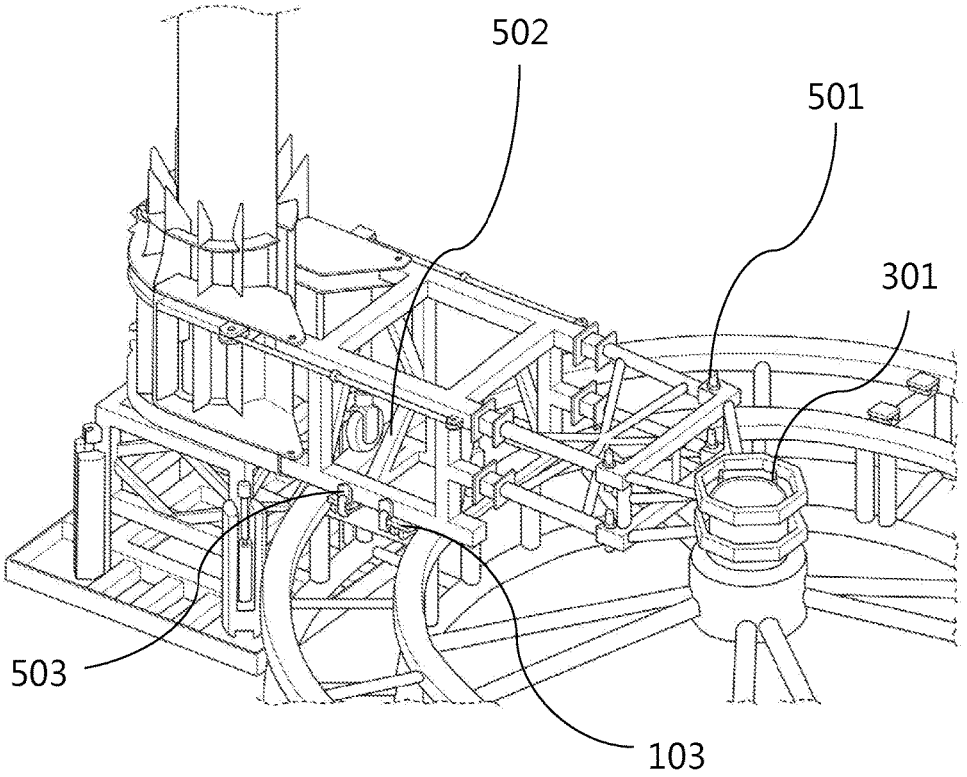
FIG. 6 is a perspective view showing the structure of the rotatable arm of the embodiment in FIG. 1.

FIG. 6 shows the structure of the rotatable arm 500 in this embodiment. As previously mentioned, the supporting frame 100 in this embodiment is provided with at least one set of at least one positioning block 102 and at least one set of at least one locking support 103, the at least one set of at least one positioning block 102 corresponds in position and number (four as in this embodiment) to the at least one leveling module 200, and so does the at least one set of at least one locking support 103. FIG. 6 shows the positions of the locking supports 103 in a certain set and also shows that the rotatable arm 500 is connected to the rotation module 300 by at least one locking member 501.

The locking members 501 in this embodiment are locking pins. Please also refer to FIG. 7 in conjunction with FIG. 1, FIG. 7 shows the structure of the slide module in this embodiment. As shown in FIG. 7, the rotatable arm 500 is provided with the slide module 502. The slide module 502 includes a T-shaped wheel mount 5021, at least one wheel 5022, and at least one guide plate 5025. Each wheel 5022 is provided with at least one first actuator 5024 and at least one damping member 5023, the at least one first actuator 5024 and the at least one damping member 5023 are connected to the wheel mount 5021 separately.

With continued reference to FIG. 7, the first actuators 5024 in the slide module 502 can work in concert with the at least one third actuator 301 in the rotation module 300 in order to lower the rotatable arm 500, the rotation module 300, and the pile guide module 400 as a whole. More specifically, a pile-driving operation begins with determining the leveling module 200 to be used. Then, the rotation module 300 rotates the rotatable arm 500 to this leveling module 200.

When the rotation is completed, the rotatable arm 500 is locked by the locking members 501 (e.g., pins), which connect the rotatable arm 500 to the rotation module 300. The locking members 501 (e.g., pins), however, are not completely locked up but leave at least one shock-absorbing space for absorbing the stress on the rotatable arm 500 during each pile-driving operation. The shock-absorbing space in this embodiment is as wide as 3 cm, but the present invention has no limitation in this regard.

After that, the first actuators 5024 in the slide module 502 work in concert with the at least one third actuator 301 in the rotation module 300 to lower the rotatable arm 500, the rotation module 300, and the pile guide module 400 together. During the lowering process, a chamfered portion of the at least one guide plate 5025 in the slide module 502 is coupled with the corresponding at least one positioning block 102 on the supporting frame 100 (see FIG. 7). Once the coupling is completed, the rotatable arm 500 lies on the supporting frame 100. To prevent the generation of stress that tends to displace the rotatable arm 500 in the left-right direction during each pile-driving operation, the rotatable arm 500 is provided with a mechanical feature, namely at least one swing clamp 503, corresponding to the at least one set of at least one locking support 103, as shown in FIG. 6.

The swing clamps 503 in this embodiment are swing clamp cylinders each having a boot-like hook mechanism. Each swing clamp 503 is inserted into the corresponding locking support 103 and then rotated so as to drive the hook mechanism rotatingly into the corresponding locking support 103, allowing the hook mechanism to hook to and clamp the corresponding locking support 103 and thereby secure the rotatable arm 500.

As the pile guide frame 10 in this embodiment is intended to work under water, it can be expected that the at least one rail surface 101 will be scattered with foreign matter fallen thereon. In light of this, the wheels 5022 in the slide module 502 are provided with the damping members 5023. In this embodiment, the damping members 5023 may be spring-loaded shock absorbers, hydraulic shock absorbers, pneumatic shock absorbers, or a combination of the above in order to effectively reduce vibrations caused by the wheels 5022 running over foreign matter. In addition, the wheels 5022 in this embodiment have an approximately 10° tolerance for lateral deviation during the rolling process. This tolerance not only contributes to the smoothness of annular movement, but also allows for deviations caused by the wheels 5022 running over foreign matter.

In other possible embodiments, the positioning of the swing clamps 503, the locking supports 103, the guide plates 5025, and the positioning blocks 102 may be assisted by a magnetic or electromagnetic means; the present invention has no limitation in this regard.

Figure 8:
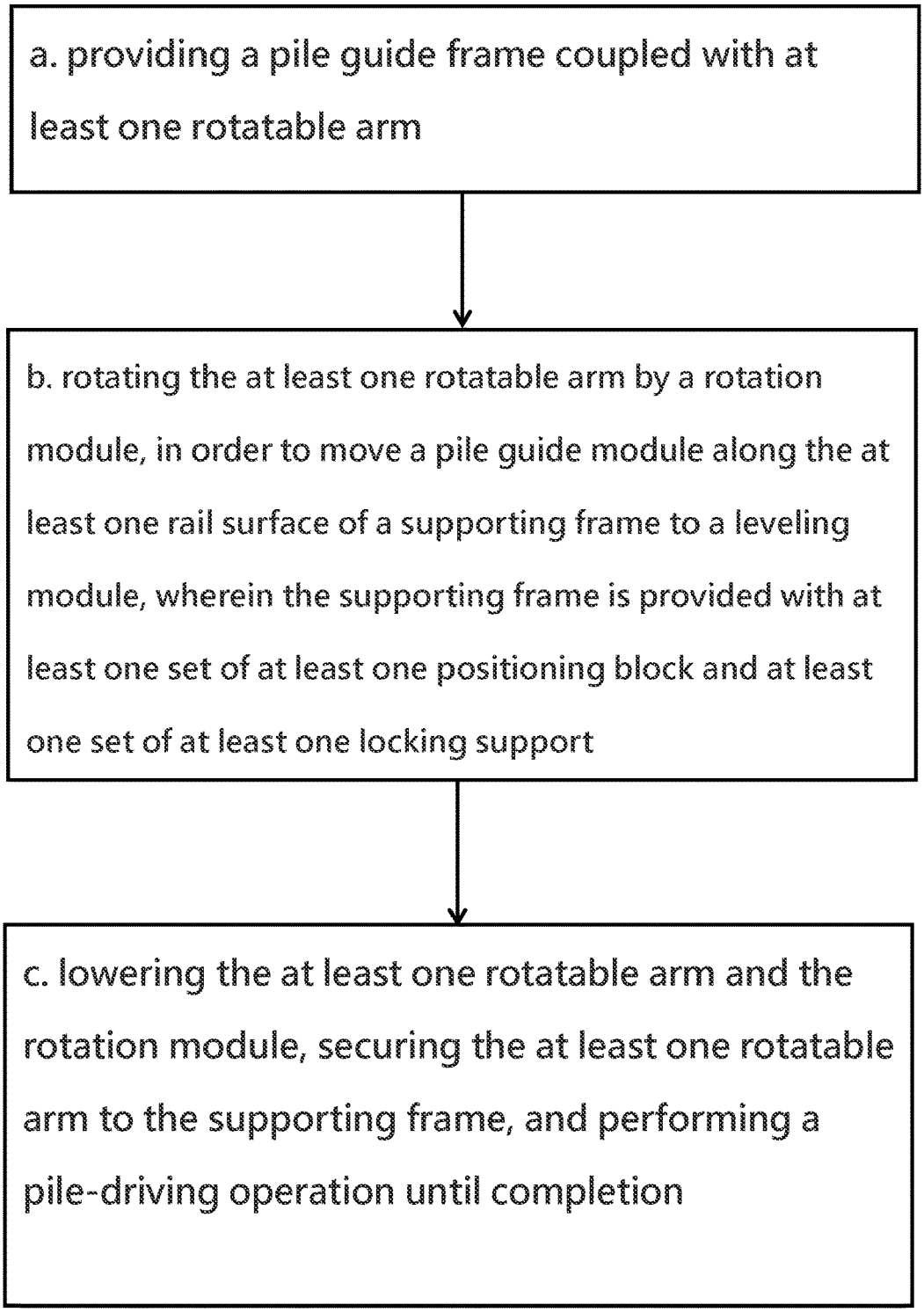
FIG. 8 is a flowchart of the operation method for the embodiment in FIG. 1.

Please refer now to FIG. 8, which shows a flowchart of the operation method of a pile guide frame coupled with at least one rotatable arm. The operation method essentially includes steps a~c and is applicable to the pile guide frame 10 coupled with the rotatable arm 500 described above with reference to FIG. 1~FIG. 7.

To begin with, a pile guide frame coupled with at least one rotatable arm is provided in step a. Then, in step b, the at least one rotatable arm is rotated by a rotation module so that a pile guide module is moved along the at least one rail surface of a supporting frame to a leveling module, the supporting frame is provided with at least one set of at least one positioning block and at least one set of at least one locking support. Lastly, in step c, the at least one rotatable arm and the rotation module are lowered, and after securing the at least one rotatable arm to the supporting frame, a pile-driving operation is performed until completion.

In step a of the operation method, a pile guide frame coupled with at least one rotatable arm is provided, such as the pile guide frame 10 coupled with the rotatable arm 500 described above with reference to FIG. 1~FIG. 7. In step b, a rotation module drives the at least one rotatable arm into rotation so that a pile guide module is moved along the at least one rail surface of a supporting frame to a leveling module, the supporting frame is provided with at least one set of at least one positioning block and at least one set of at least one locking support. For example, the rotation module 300 moves the pile guide module 400 through the rotatable arm 500 to one of the leveling modules 200 according to the position of this leveling module 200. After that, step c is performed by lowering the at least one rotatable arm and the rotation module, securing the at least one rotatable arm to the supporting frame, and performing a pile-driving operation until the operation is completed.

While performing step b, the leveling module 200 in question adjusts its own height or inclination angle through the corresponding at least one fourth actuator 201. In fact, whether the supporting frame 100 can lie horizontally on the seabed depends on the positional or angular adjustment of each leveling module 200. Once the supporting frame 100 is horizontal, a pile P is received in the pile guide module 400, and when the rotation module 300 rotates the rotatable arm 500, the rotatable arm 500 moves on the at least one rail surface 101 through the at least one wheel 5022 on the rotatable arm 500.

In step c, the lowering of the rotatable arm 500, the pile guide module 400, and the rotation module 300 is performed after the locking members 501 secure the rotatable arm 500 to the rotation module 300 and is concluded by sequentially securing the at least one guide plate 5025 and the at least one swing clamp 503 on the rotatable arm 500 to the corresponding at least one positioning block 102 and the corresponding at least one locking support 103 on the supporting frame 100. Vertical movement of the entire mechanism is enabled by the third actuator 301 and the first actuators 5024.

Besides, during the pile-driving operation of step c, the first pile securing member 401 and the second pile securing member 402 are locked by the pile securing lock 405 in the pile guide module 400 to ensure stability of the pile-driving operation.

Furthermore, steps a~c may be followed by steps d~g. In step d, the pile guide module is unlocked, a first pile securing member and a second pile securing member of the pile guide module are then opened, and the at least one rotatable arm and the rotation module are lifted. For example, once the pile-driving operation of the pile P is completed, the first pile securing member 401 and the second pile securing member 402 of the pile guide module 400 are opened, and the swing clamp 503 in each locking support 103 is unlocked, so that the pile guide module 400 can be further moved without being restricted or interfered with by the pile P. After that, the third actuator 301 and the first actuators 5024 move the rotatable arm 500 and the rotation module 300 upward.

Following the upward movement, the rotation module moves the at least one rotatable arm, and hence the pile guide module, to the next leveling module in step e, in order for the pile guide module to receive the next pile. The content of step e is in fact the same as the content of step b. Then, step f is performed by lowering the at least one rotatable arm and the rotation module, securing the at least one rotatable arm to the supporting frame, and performing a pile-driving operation on the pile received in the pile guide module until the operation is completed. The content of step f is identical to that of step c. Steps e and f are different from steps b and c only in that the leveling module 200 has changed in position. Step g is performed by repeating steps d~f until pile-driving operations corresponding to all the leveling modules are completed, e.g., until pile-driving operations corresponding to all the leveling modules 200 of the pile guide frame 10 are completed.

What is claimed is:

1. A pile guide frame coupled with at least one rotatable arm, comprising:

a supporting frame provided with at least one rail surface;

a rotation module provided at a center of the supporting frame;

at least one leveling module connected to the supporting frame;

the at least one rotatable arm, connected to the rotation module and movably in contact with the at least one rail surface; and a pile guide module connected to each of the at least one rotatable arm;

wherein the supporting frame is provided with at least one set of at least one positioning block and at least one set of at least one locking support, the at least one set of at least one positioning block corresponds in position and number to the at least one leveling module, and so does the at least one set of at least one locking support.

2. The pile guide frame according to claim 1, wherein each of the at least one rotatable arm is provided with at least one swing clamp corresponding to the at least one locking support in each of the at least one set of at least one locking support.

3. The pile guide frame according to claim 1, wherein each of the at least one rotatable arm is connected to the rotation module through at least one locking member.

4. The pile guide frame according to claim 1, wherein each of the at least one rotatable arm is provided with a slide module comprising:

a wheel mount connected to the each of the at least one rotatable arm;

at least one wheel mounted on the wheel mount and each in contact with one of the at least one rail surface; and at least one guide plate provided on the wheel mount and corresponding in position and number to the at least one positioning block in each of the at least one set of at least one positioning block;

wherein each of the at least one wheel is provided with at least one first actuator connected to the wheel mount and at least one damping member connected to the wheel mount.

5. The pile guide frame according to claim 4, wherein the pile guide module connected to each of the at least one rotatable arm comprises:

a first pile securing member; and a second pile securing member fastenable to the first pile securing member through a pile securing lock;

wherein each of the first securing member and the second pile securing member is connected to the each of the at least one rotatable arm through a second actuator, and the first pile securing member and the second pile securing member are configured to be opened with respect to each other, thus forming a predetermined included angle which is controlled by the pulling/releasing actions of the second actuator therebetween.

6. The pile guide frame according to claim 5, wherein the predetermined included angle ranges from 0° to 120°.

7. The pile guide frame according to claim 5, wherein each said first pile securing member is provided with at least two supporting structures, and so does each said second pile securing member.

8. The pile guide frame according to claim 5, wherein the rotation module is provided with at least one third actuator, and the rotation module is a hydraulic motor.

9. The pile guide frame according to claim 8, wherein a first adjusting member is provided between each of the at least one leveling module and the supporting frame, and each of the at least one leveling module is provided with at least one fourth actuator.

10. The pile guide frame according to claim 4, wherein each said damping member is a spring-loaded shock absorber, a hydraulic shock absorber, a pneumatic shock absorber, or a combination thereof.

11. The pile guide frame according to claim 1, wherein the supporting frame is composed of at least one ring-shaped frame, and a center of the supporting frame is the center of gravity of the at least one ring-shaped frame.

* * * * *